US010167644B1

(12) United States Patent
Aliev

(10) Patent No.: US 10,167,644 B1
(45) Date of Patent: Jan. 1, 2019

(54) MODULAR PORTABLE SOUND ISOLATION ENCLOSURE

(71) Applicant: Adil Aliyevich Aliev, Jefferson, MD (US)

(72) Inventor: Adil Aliyevich Aliev, Jefferson, MD (US)

( * ) Notice: Subject to any disclaimer, the term of this patent is extended or adjusted under 35 U.S.C. 154(b) by 0 days.

(21) Appl. No.: 15/636,097

(22) Filed: Jun. 28, 2017

(51) Int. Cl.

| | |
|---|---|
| ***E04H 1/12*** | (2006.01) |
| ***E04H 15/44*** | (2006.01) |
| ***E04H 15/54*** | (2006.01) |
| ***E04H 15/64*** | (2006.01) |

(52) U.S. Cl.
CPC ..... *E04H 1/12* (2013.01); *E04H 15/44* (2013.01); *E04H 15/54* (2013.01); *E04H 15/64* (2013.01)

(58) Field of Classification Search
CPC ..... E04H 1/12
See application file for complete search history.

(56) References Cited

U.S. PATENT DOCUMENTS

| | | | | |
|---|---|---|---|---|
| 1,966,288 A | | 7/1934 | Foltz | |
| 2,155,876 A | * | 4/1939 | Stout | B60P 3/34 135/96 |
| 3,611,907 A | | 10/1971 | Wasserman et al. | |
| 3,905,444 A | | 9/1975 | Evans, Jr. | |
| 3,935,923 A | | 2/1976 | Wheeler | |
| 3,951,228 A | | 4/1976 | Schnell | |
| 4,706,551 A | * | 11/1987 | Schofield | B08B 15/026 454/66 |
| 4,942,938 A | | 7/1990 | Wiegel | |
| 5,123,874 A | | 6/1992 | White, III | |
| 5,525,765 A | | 6/1996 | Freiheit | |
| 5,530,211 A | | 6/1996 | Rogers et al. | |
| 5,555,681 A | * | 9/1996 | Cawthon | A01G 9/16 52/63 |
| 5,646,378 A | | 7/1997 | Van Haaff | |

(Continued)

FOREIGN PATENT DOCUMENTS

| | | |
|---|---|---|
| CN | 105317248 | 2/2016 |
| SE | 1551458 | 5/2017 |
| WO | WO2017081169 | 5/2017 |

*Primary Examiner* — Noah Chandler Hawk
(74) *Attorney, Agent, or Firm* — Greenblum & Bernstein, P.L.C.

(57) ABSTRACT

A mobile modular sound isolation enclosure having a swing opening door, wherein the sound isolation enclosure is collapsible into a carry bag and shippable by a regular postal carrier. The sound isolation enclosure includes a modular frame structure having structural members that are assemblable in different configurations so as to form frames of different shapes and/or sizes. The sound isolation enclosure further includes a door frame module, which includes a swing open door frame. The sound isolation enclosure additionally includes a plurality of modular soundproofing panels including flexible composite layered sound blocking material and sound absorbent sheet material. At least one of the plurality of modular soundproofing panels may include the swing open door. Each of the plurality of modular sound proofing panels comprise attachers operable to connect adjacent sound proofing panels consecutively to one another to form a continuous wall of the sound isolation enclosure. The modular sound isolation enclosure can be extended horizontally (e.g., in width and length), as well as vertically (e.g., in height).

18 Claims, 12 Drawing Sheets

(56) References Cited

U.S. PATENT DOCUMENTS

| | | | | |
|---|---|---|---|---|
| 5,651,405 | A | 7/1997 | Boeddeker et al. | |
| 7,815,011 | B2 | 10/2010 | Holzman et al. | |
| 7,918,312 | B2 | 4/2011 | Carlson | |
| 8,136,626 | B1 | 3/2012 | Aliev | |
| 8,646,571 | B2 | 2/2014 | Aliev | |
| 8,943,760 | B2 * | 2/2015 | Okuda | E04H 1/1205 135/123 |
| 8,978,816 | B2 | 5/2015 | Slotznick | |
| 9,752,345 | B1 * | 9/2017 | LaHood | E04H 15/18 |
| 2009/0014044 | A1 * | 1/2009 | Hartman | E04B 1/3445 135/143 |
| 2017/0234029 | A1 * | 8/2017 | Walter | E04H 15/54 135/147 |

* cited by examiner

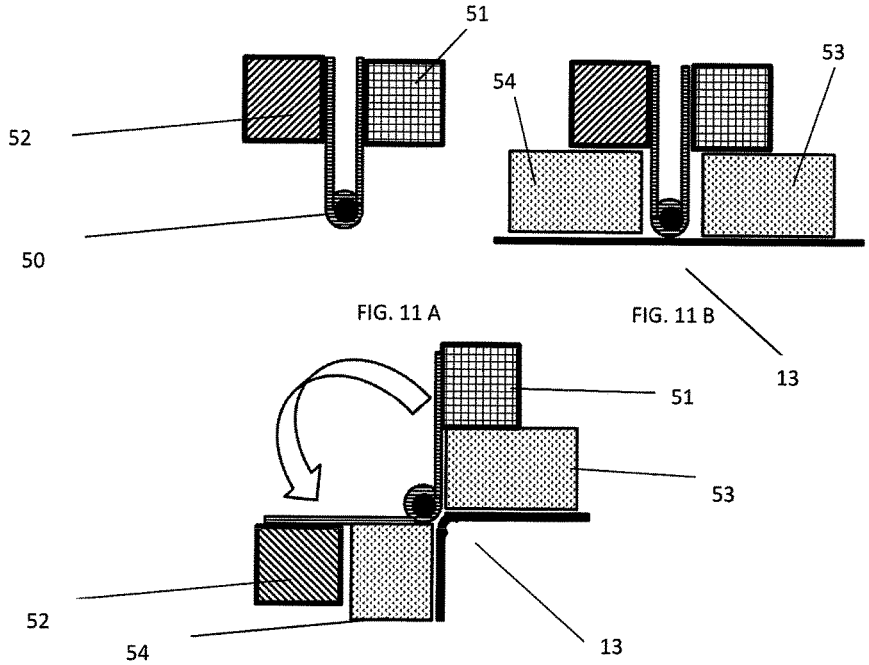
FIG. 11 A
FIG. 11 B
FIG. 11 C
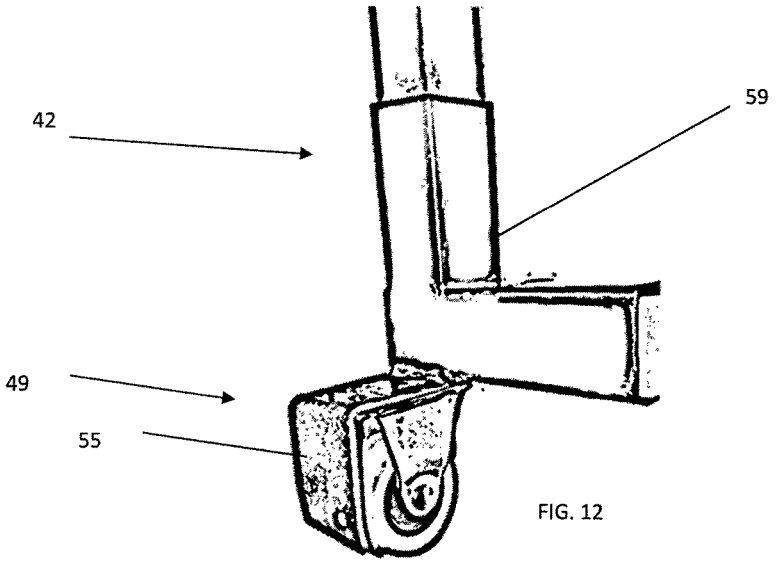
FIG. 12

MODULAR PORTABLE SOUND ISOLATION ENCLOSURE

BACKGROUND OF THE DISCLOSURE

1. Field of the Disclosure

Aspects of the disclosure relate generally to the field of sound isolation enclosures, and more specifically to portable sound booths for, e.g., audio recording, audiology testing, and/or music practice environments, for noise pollution reduction and such.

2. Background Discussion

Rapid advancements in technology, audio recording equipment and audio editing software created possibilities for people to record their music at home. Yet high quality recording requires higher quality equipment and more sensitive microphones, which are more sensitive to noise pollution. Editing software allows for editing out the noise, but that process removes certain frequencies, thus making the final product of lower quality. So regardless of the technology and software, acoustic conditions and keeping the recording environment quiet are paramount.

Additionally, as people tend to live closer together in the city apartments and gated communities noise pollution regulations get more strict, therefore practicing music and/or singing at home can become a nuisance to the neighbors, and a disturbance to the neighborhood that can carry administrative fines. Furthermore, the simple notion that someone can hear a person practicing can place a restraint on that person's creativity and limit their freedom of exercising their skills at the time convenient to them.

Another challenge is for audiometry professionals. Audiometry technicians often have to travel to a location to conduct hearing tests. And audiometry technicians may need to meet very strict requirements regarding the environment in which the test is being conducted. Namely the test room must be quiet. Existing mobile sound isolation enclosures that are currently being used for audiometry are huge, extremely heavy and impractical for technicians in the field to manage. Audiometry technicians require a heavy cargo truck to deliver the booth to a location. Moreover, the assembly is laborious, takes long time, and requires people with special skills and special tools.

Another challenge is the noise pollution at production plants caused by working machinery. The existing methods of soundproofing are very inefficient, and most of the time it is either being a blanket hang on a fence around the equipment or a custom built box.

Attempts have been made to create mobile sound isolation enclosures, but they all fall short in mobility and/or convenience. With some embodiments, a blanket is thrown over a top bar of a frame and connected around the bottom bar of the frame creating a "double wall" construction with a fillable space for other soundproofing materials. In reality such approach is not practical for the simple reason that once you fill up the space between the walls with additional soundproofing materials (such as rock-wool or mass loaded vinyl), the resulting structure is not readily portable. Rock-wool is very hazardous material and cannot be disturbed multiple times, as particles would go into the air. Even if rock-wool may be enclosed in a fabric it still can make its way through, enclosing the rock-wool into an airtight material such as vinyl or plastic will prevent sound from going through and the wall will become reflective, which acoustically undesirable.

While some approaches use mass loaded vinyl, this presents its own challenges. For example, vinyl is not very durable and can tear easily. Additionally, while mass loaded vinyl may be arranged to hang over a top bar in the same manner as the outer blanket wall, such an arrangement will defeat the purpose of the booth being portable, as such an assembly would be very difficult and cumbersome.

Therefore there is a need to in various fields for a sound isolation enclosure that is sufficiently soundproof, yet can be easily assembled and disassembled, and more easily transported.

BRIEF SUMMARY OF THE EMBODIMENTS OF THE DISCLOSURE

Aspects of the disclosure are directed to a mobile modular sound isolation enclosure having a swing opening door, wherein the sound isolation enclosure is collapsible into a carry bag and shippable by a regular postal carrier. The sound isolation enclosure comprises a modular frame structure comprising structural members that are assemblable in different configurations so as to form frames of different shapes and/or sizes, and a door frame module, including a swing open door frame. The sound isolation enclosure additionally comprises a plurality of modular soundproofing panels comprising flexible composite layered sound blocking material and sound absorbent sheet material, wherein at least one of the plurality of modular soundproofing panels includes the swing open door, and wherein each of the plurality of modular sound proofing panels comprise attachers operable to connect adjacent sound proofing panels consecutively to one another to form a continuous wall of the soundproof enclosure.

In embodiments, the frame structure is assemblable into different configurations of different sizes and/or shapes by adding on or subtracting components.

In some embodiments, when the plurality soundproof panels are arranged on the frame to form the soundproof enclosure, a sound isolation enclosure is formed.

In additional embodiments, the modular sound isolation enclosure further comprises a plurality of light-weight frame components and a plurality of connectors that are assemblable to form the modular frame structure (and disassemblable) by a single person without need for tools.

In yet further embodiments, the frame is structured to be repeatedly disassembled and reassembled multiple times as needed.

In embodiments, the frame is sized such that in a disassembled state, the frame is able to fit in a trunk of a car.

Aspects of the disclosure are directed to a mobile modular sound isolation enclosure comprising a frame, a swing opening door; and a plurality of soundproof panels that when arranged on the frame, creates an enclosed soundproof room.

In embodiments, the soundproof panels comprise layered composite material to increase the soundproofing efficiency of the panels.

In embodiments, the soundproof panels comprise layered composite material with intermittent sound blocking and sound absorbing layers structured and arranged to remain flexible, such that the soundproof panels can be folded and/or rolled away.

In additional embodiments, the soundproof panels further comprise a limp mass barrier reinforced with fabric.

In yet further embodiments, the soundproof panels are structured and arranged to hang on the fame without permanent attachment thereto.

In embodiments, the soundproof swing open door is structured and arranged to be disassembled and rolled away.

In some embodiments, the attachers comprise a first zipper element attached to one panel with a corresponding second zipper element on an adjacent panel.

In additional embodiments, the attachers additionally comprise a flap attached to one panel with a connecting surface that is engageable with a corresponding connecting surface of an adjacent panel.

In yet further embodiments, the flap, when the connecting surface is engaged with the corresponding connecting surface is operable to cover the first and second zipper elements.

In embodiments, at least some of the plurality of modular soundproofing panels comprise hook brackets attached thereto, which are structured and arranged to engage with the modular frame structure so that the modular soundproofing panels hang from the modular frame structure.

In some embodiments, the structural members comprise a plurality of structural poles and a plurality of connectors that are assemblable in different configurations.

In additional embodiments, the plurality of connectors comprise two-way connectors and corner 3-way connectors.

In yet further embodiments, the plurality of connectors additionally comprise T-connectors, 3-way wide angle roof connectors, 4-way wide angle roof connectors, 4-way middle angular connectors, and curved connectors.

In yet further embodiments, the continuous wall of the sound isolation enclosure includes one or more soundproofing panels forming a roof of the soundproof enclosure.

Aspects of the disclosure are directed to a mobile sound isolation enclosure comprising frame elements and multi-layered composite wall and roof panels, which are removably attached to a frame (assembled from the frame elements), and to each other, and in a fully assembled state, forms a complete sound isolation enclosure in one of a plurality of shapes and sizes. Embodiments of the disclosure include a swing open door, multi layered composite soundproofing walls, modular parts allowing for assembly booths in different size by adding more of the same elements, create partitions inside the enclosure and so on. And yet retaining the ability of the entire unit in disassembled state, to be rolled, packed in bags and shipped by a common postal carrier or be driven in a regular passenger car (e.g., a sedan).

Aspects of the disclosure are directed to several features, including:

a) the composite multilayered panel design, in which the sound proof panels include at least one limp mass sound barrier reinforced with fibrous material for durability and to withstand multiple roll-ups, folding and unfolding to block sound waves, and at least one layer of sound absorbing fibrous material to absorb sound energy. In embodiments, these layers may be repeated to increase soundproofing capacity of the panels;

b) the soundproof panel's outer case that accommodates the soundproofing panels and serves to anchor fasteners, attachments and other design features. This outer shell (or case) also functions to contain the fibers of the fibrous material that may become airborne. While it is possible that the attachments can be installed on the soundproof panels themselves, but, considering the thickness, density and the weight of the composite material it may be impractical. Thus, in accordance with aspects of the disclosure, in embodiments, the attachments are installed on the outer case of the soundproof panel;

c) a swing door frame assembly that can be attached to the assembled frame and supports a door panel made in the same manner as all other panels (e.g., flexible, not rigid), such that the door can be rolled up for easy transportation;

d) fasteners connecting the panels, comprising a fastener to join the panels together plus at least one additional soundproof flap to cover the connection and prevent the sound from leaking in or out of the enclosure; and e) the method in which the said sound proof panels are attached to the frame itself, supporting the weight of each individual panel on specially designed hook brackets, which allows for easier wall installation and for increased weight/density of the panels to increase their soundproofing capacity.

The advantages of implanting aspects of the disclosure include improved soundproofing efficiency, ability to extend the size of the enclosure using the same elements (e.g., modularity), ease of assembly of panels by using hook brackets, convenience of a swing open door, and still preserving the ability of the whole structure to be disassembled and rolled into packing bags, e.g., for easy transportation.

Embodiments, of aspects of the disclosure are designed to function, for example, as a vocal booth, portable audiology booth, photo booth, and mobile sound isolation enclosure.

In some contemplated embodiments, the sound isolation enclosure may be extended not only horizontally (e.g., in width and/or length) but also vertically (e.g., in height). With such contemplated embodiments, for example, a sound isolation enclosure may be arranged around tall machinery, or a studio may be configured with a 12 foot tall ceiling, for example.

Other aims and advantages of the present disclosure will become apparent from the following descriptions, taken in connection with the accompanying drawings, wherein, by way of illustration and example, an embodiment of the present disclosure is disclosed.

BRIEF DESCRIPTION OF THE DRAWINGS

The novel features which are characteristic of the systems, both as to structure and method of operation thereof, together with further aims and advantages thereof, will be understood from the following description, considered in connection with the accompanying drawings, in which embodiments of the system are illustrated by way of example. It is to be expressly understood, however, that the drawings are for the purpose of illustration and description only, and they are not intended as a definition of the limits of the disclosure. For a more complete understanding of the disclosure, as well as other aims and further features thereof, reference may be had to the following detailed description of the embodiments of the disclosure in conjunction with the following exemplary and non-limiting drawings wherein:

FIG. 11A is a diagram representing the door hinge design, attached to the door frame. Door closed. Cross sectional view from the top in accordance with aspects of the disclosure;

FIG. 11B is a cross sectional top view of an exemplary and non-limiting embodiment of a door hinge, with soundproof panels attached, (Door Closed). in accordance with aspects of the disclosure;

FIG. 11C is a cross sectional top view of the door hinge, with soundproof panels attached (Door Open) in accordance with aspects of the disclosure;

FIG. 12 depicts a wheel caster attached to the door frame in accordance with aspects of the disclosure;

DETAILED DESCRIPTION OF THE EMBODIMENTS OF THE DISCLOSURE

Figure 1:
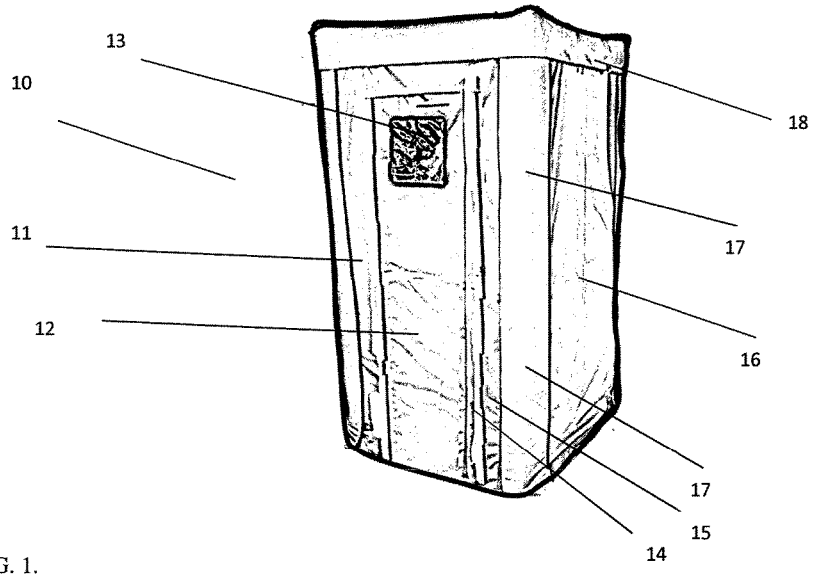
FIG. 1 is a perspective view of an exemplary and non-limiting embodiment of the disclosure assembled as module in an exemplary first configuration (e.g., SPB33) in accordance with aspects of the disclosure.

Detailed descriptions of the embodiments of the disclosure are provided herein. It is to be understood, however, that the present disclosure may be embodied in various forms. Therefore, specific details disclosed herein are not to be interpreted as limiting, but rather as a basis for the claims and as a representative basis for teaching one skilled in the art to employ the present disclosure in virtually any appropriately detailed system, structure or manner.

In the following description, the various embodiments of the present disclosure will be described with respect to the enclosed drawings. As required, detailed embodiments of the embodiments of the present disclosure are discussed herein; however, it is to be understood that the disclosed embodiments are merely exemplary of the embodiments of the disclosure that may be embodied in various and alternative forms. The Figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded. For example, as used herein, the indefinite article "a" indicates one as well as more than one and does not necessarily limit its referent noun to the singular.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

As used herein, the terms "about" and "approximately" indicate that the amount or value in question may be the specific value designated or some other value in its neighborhood. Generally, the terms "about" and "approximately" denoting a certain value is intended to denote a range within ±5% of the value. As one example, the phrase "about 100" denotes a range of 100±5, i.e. the range from 95 to 105. Generally, when the terms "about" and "approximately" are used, it can be expected that similar results or effects according to the disclosure can be obtained within a range of ±5% of the indicated value.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, or any other value or range within the range.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. The term "parallel" refers to deviating less than 5° from mathematically exact parallel alignment. Similarly "perpendicular" refers to deviating less than 5° from mathematically exact perpendicular alignment.

The term "at least partially" is intended to denote that the following property is fulfilled to a certain extent or completely.

The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for instance a composition comprising a compound A may include other compounds besides A. However, the term "comprising" also covers the more restrictive meanings of "consisting essentially of and" consisting of", so that for instance "a composition comprising a compound A" may also (essentially) consist of the compound A.

The various embodiments disclosed herein can be used separately and in various combinations unless specifically stated to the contrary.

Figure 2:
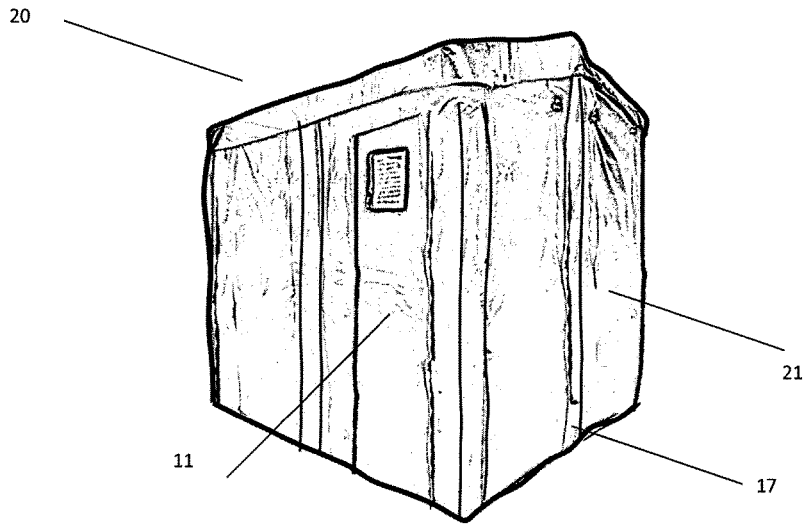
FIG. 2 is a perspective view of an exemplary and non-limiting embodiment of the disclosure assembled as module in an exemplary second configuration (e.g., SPB66) in accordance with aspects of the disclosure.

Referring now to FIGS. 1-2 there is shown an overview of the two exemplary configurations of embodiments of the disclosure in fully assembled state. FIG. 1 is a perspective view of an exemplary and non-limiting embodiment of the disclosure assembled as module in an exemplary first configuration (e.g., SPB33) in accordance with aspects of the disclosure. FIG. 2 is a perspective view of an exemplary and non-limiting embodiment of the disclosure assembled as module in an exemplary second configuration (e.g., SPB66) in accordance with aspects of the disclosure.

Referring now to FIG. 1, there is shown a sound proof booth module 10, hereinafter referred to as "SPB33," which has a rectangular (e.g., square) footprint and a flat roof top. Soundproofing panel 11 comprises a movable swing door panel 12 (with an optional window 13) that is connected by a hinge flap (e.g., a permanently attached hinge flap 14) to a stationary portion of the panel 15. Panel 15 connects to soundproof wall panel 16 (and other adjacent panel) using, for example, releasable fasteners (not shown) that are covered from the outside with an outer flap 17. The top roof panel (not shown) also connects to the wall panels and the connections are covered with a roof flap 18.

Referring now to FIG. 2 there is shown a module 20, hereinafter referred to as SPB66, which is a unit with rectangular (e.g., square) footprint and a pitched roof top. This module is designed in a similar manner except that some walls 21 have shape configured to accommodate for the pitched roof profile.

Figure 3:
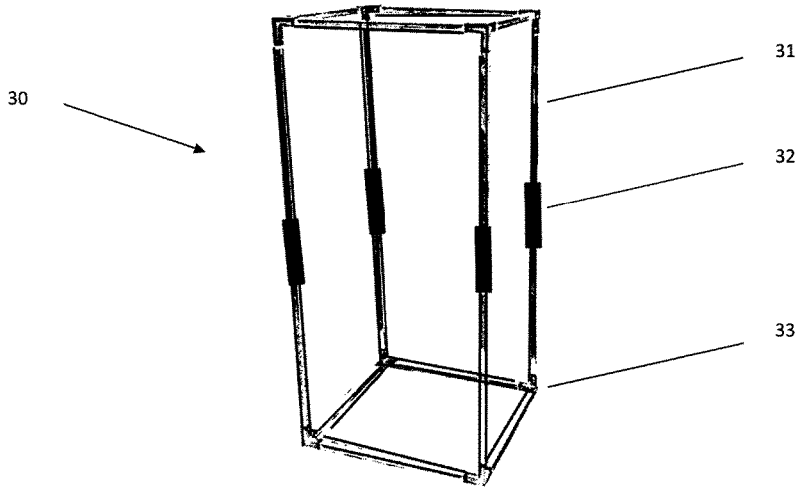
FIG. 3 is a perspective view of the frame of the embodiment assembled in the exemplary first configuration (e.g., as module SPB33 frame) in accordance with aspects of the disclosure.

Referring now to FIGS. 3 to 7 there is shown a frame structure that supports the soundproofing panels. FIG. 3 is a perspective view of the frame of the embodiment assembled in the exemplary first configuration (e.g., as module SPB33 frame) in accordance with aspects of the disclosure. As shown in FIG. 3, a frame 30 for SPB33 module comprises structural poles 31 (e.g., straight poles), two-way connectors 32 (e.g., straight two-way connectors), and corner 3-way connectors 33. In an exemplary embodiment, all parts (e.g., poles, two-way, and three-way connectors) of the frame are releasably connected (e.g., connections between poles and two-way or three-way connectors) utilizing ball lock connectors (not shown), although any other method of securing the parts can be used. In embodiments, the poles may comprise aluminum or some other suitable metal. In other embodiments, the poles may comprise a polymer or plastic material. In embodiments, the structures (or modules) are designed such that the poles are all the same length (except for the door frame poles, which may be sized differently). In accordance with aspects of the disclosure, this enables a more easily-assembeable structure. In embodiments, the connectors may comprise steel, nylon, hard rubber (e.g., coated), and may be structured to reduce the weight and/or absorb structural vibrations, and/or cancel sound resonance.

Figure 4:
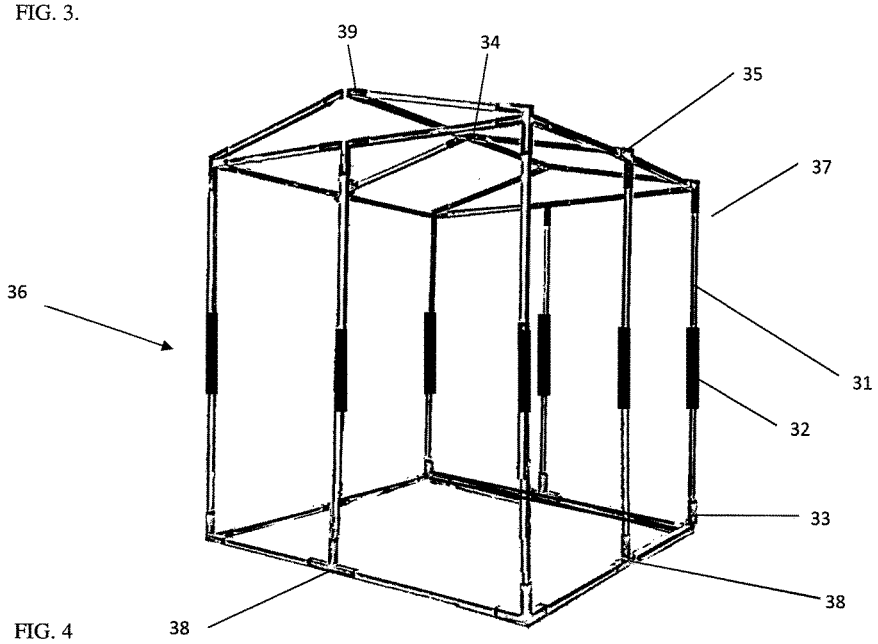
FIG. 4 is a perspective view of the frame embodiment assembled in the exemplary second configuration (e.g., as module SPB66 frame) in accordance with aspects of the disclosure.

FIG. 4 is a perspective view of the frame embodiment assembled in the exemplary second configuration (e.g., as module SPB66 frame) in accordance with aspects of the disclosure. As shown in FIG. 4, a frame 36 for the larger module SPB66 may be made out of same parts as the frame for module SPB33 with the addition of 4-way angular connectors 37 in accordance with aspects of the disclosure, left and right to accommodate the pitched roof design. Other connector shapes used in the SPB66 frame construction are T-connectors 38, 3-way wide angle roof connectors 39, 4-way wide angle roof connectors 34, and 4-way middle angular connector 35. In accordance with aspects of the disclosure, the pitched roof design allows to have a larger footprint of the booth without additional supports in the middle.

Figure 5:
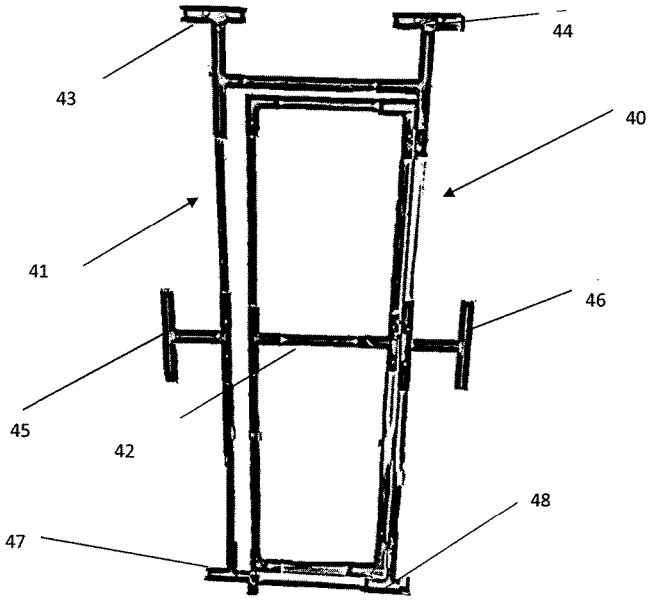
FIG. 5 is a perspective view of the Swing Door Module in accordance with aspects of the disclosure.

FIG. 5 is a perspective view of the Swing Door Module in accordance with aspects of the disclosure. As shown in FIG. 5, a swing door frame module 40 that can be installed in the SPB33 or SPB66 modules at any part of the wall (e.g., any vertical facet of the frame). In such a manner, the booth modules are configurable and customizable as to where the door is arranged, which is important when building modular structure. In embodiments, a structure may have more than one door per booth (e.g., in and out, "pass through" booth). As shown in FIG. 5, the door frame module 40 includes a door frame 41 and swing door 42. The swing door 42 is sized to provide clearance between the swing door 42 and the door frame. For example, in embodiments, the swing door may be sized to provide clearance of approximately one inch between the top and bottom frame elements of the swing door 42 and the door frame. Door frame 41 is attached to the top horizontal member of a SPB frame by top door connectors 43 and 44 and to the bottom horizontal member of the SPB frame by the bottom connectors 47 and 48. Middle H-connectors 45 and 46 provide additional stability of the door assembly. Connectors 44, 46 and 48 each include a hinged connection to the door 42. In accordance with aspects of the disclosure, in embodiments, the door frame module 40 comprises the same materials as the rest of the booth (e.g., aluminum poles and steel connectors). In embodiments, the hinges of the hinged connections of connectors 44, 46 and 48 may be welded (e.g., permanently) to the door connectors or have a detachable design, e.g., using "hook and loop" type hinge, such that the whole door frame portion may be removed from door frame assembly as one separate piece.

Figure 6A:
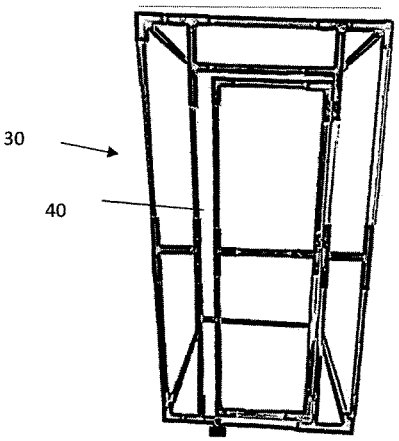
FIG. 6A is a perspective view of the exemplary first configuration (e.g., Module SPB33) frame with a Swing Door Frame module installed therein (Door Closed) in accordance with aspects of the disclosure.

FIG. 6A is a perspective view of the exemplary first configuration (e.g., Module SPB33) frame with a Swing Door Frame module installed therein (Door Closed) in accordance with aspects of the disclosure. As shown in FIG. 6A, a SPB33 module 30 includes a Door frame module 40 installed therein.

Figure 6B:
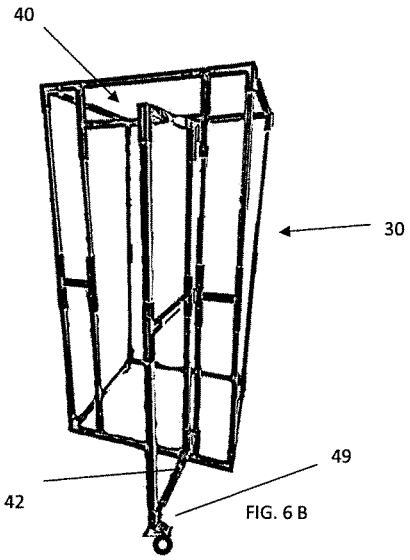
FIG. 6B is a perspective view of the exemplary first configuration (e.g., Module SPB33) frame with the Swing Door Frame module installed therein. (Door Open) in accordance with aspects of the disclosure.

FIG. 6B is a perspective view of the exemplary first configuration (e.g., Module SPB33) frame with the Swing Door Frame module installed therein. (Door Open) in accordance with aspects of the disclosure. As shown in FIG. 6B, the SPB33 module 30 includes a Door frame module installed and the door 42 is open. In an exemplary embodiment the door 42 in open position may be supported by a wheeled caster 49 structured and arranged to support the weight of the door 42 and the soundproof panels (not shown) attachable thereto.

Figure 7:
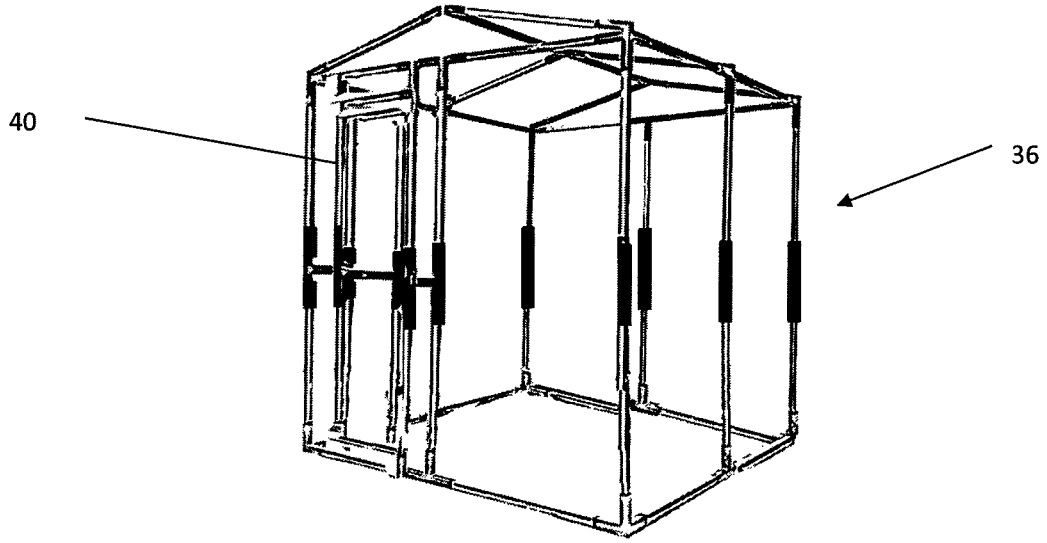
FIG. 7 is a perspective view of the exemplary second configuration (e.g., Module SPB66) frame with the Swing Door Frame module installed therein (Door Closed) in accordance with aspects of the disclosure.

FIG. 7 is a perspective view of the exemplary second configuration (e.g., Module SPB66) frame 36 with the Swing Door Frame module 40 installed therein with the door closed in accordance with aspects of the disclosure. In embodiments, the door panel may be configured based on the shape of the roof enclosure. For example, if the enclosure has a pitched roof, then the door panel may have a corresponding shape.

Figure 8A:
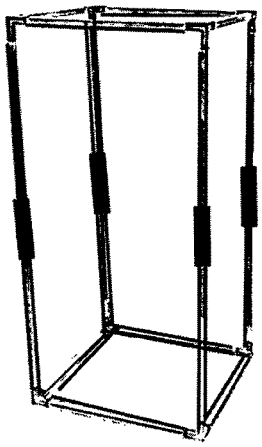
FIG. 8A is a perspective view of the Module SPB33 frame in accordance with aspects of the disclosure.

Referring now to FIGS. 8A to 10B there are shown different assembly options to assemble the modules in various configurations in accordance with aspects of the disclosure. FIG. 8A is a perspective view of the Module SPB33 frame 30. Referring now to FIG. 8A there is shown the SPB33 module as a reference point. In accordance with aspects of the disclosure, the frame 30 is reconfigurable (or a plurality of frames 30 is combinable) into different configurations (e.g., depending on a particular application or current need).

Figure 8B:
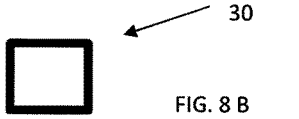
FIG. 8B is a diagram representing the SPB33 module as viewed from top in accordance with aspects of the disclosure.
Figure 8C:
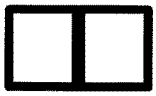
FIG. 8C is a diagram representing two SPB33 modules joined side by side to form a rectangular (e.g., 6×3) enclosure as viewed from top in accordance with aspects of the disclosure.

FIG. 8B is a diagram representing the SPB33 module as viewed from top in accordance with aspects of the disclosure. The diagram on FIG. 8B represents the square footprint of the SPB33. FIG. 8C is a diagram representing two SPB33 modules 30 joined side by side to form a rectangular (e.g., 6'×3') enclosure as viewed from top in accordance with aspects of the disclosure. For example, when two SPB33 modules 30 are connected side-by-side they will form a new unit SPB 6×3, as shown in FIG. 8C.

Figure 8D:
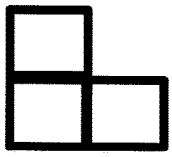
FIG. 8D is a diagram representing three SPB33 modules joined side by side to form an L-shaped enclosure in accordance with aspects of the disclosure.
Figure 8E:
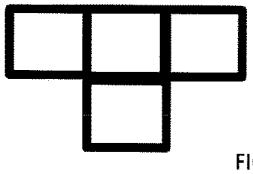
FIG. 8E is a diagram representing four SPB33 modules joined side by side to form a T-shaped enclosure in accordance with aspects of the disclosure.

FIG. 8D is a diagram representing three SPB33 modules 30 joined side by side to form an exemplary L-shaped enclosure in accordance with aspects of the disclosure. For example, three SPB33 modules 30 can be attached together in L-shape as diagram in FIG. 8D. FIG. 8E is a diagram representing four SPB33 modules 30 joined side-by-side to form a T-shaped enclosure in accordance with aspects of the disclosure. Of course, the disclosure contemplates any number of configurations are achievable by combining various numbers of modules. In such a manner, in accordance with aspects of the disclosure, a plurality of frames 30 is combinable into different configurations (e.g., depending on a particular application or current need).

Figure 9A:
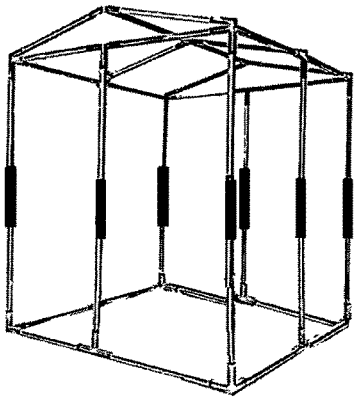
FIG. 9A is a perspective view of the Module SPB66 frame in accordance with aspects of the disclosure.

FIG. 9A is a perspective view of the Module SPB66 frame 36. In accordance with aspects of the disclosure, the frame 36 is reconfigurable (or a plurality of frames 30 and/or 36 is combinable) into different configurations (e.g., depending on a particular application or current need). Referring now to FIG. 9A, there shown a SPB66 module 36 as a reference.

Figure 9B:
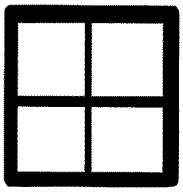
FIG. 9B is a diagram representing the SPB66 module as viewed from top in accordance with aspects of the disclosure.
Figure 9C:
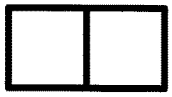
FIG. 9C is a diagram representing half of the SPB66 module to form a rectangular (e.g., 6×3) enclosure as viewed from top in accordance with aspects of the disclosure.

FIG. 9B is a diagram representing the SPB66 module 36 as viewed from top in accordance with aspects of the disclosure. SPB66 also has a square footprint as shown in FIG. 9B with bold outline cross members of the roof shown in thinner lines. FIG. 9C is a diagram representing half of the SPB66 module (labeled as 36/2) to form a rectangular (e.g., 6×3) enclosure as viewed from top in accordance with aspects of the disclosure. The SPB66 has a pitched roof and in accordance with aspects of the disclosure, this module can also be reconfigured in a "half-size" footprint creating a 6×3 footprint (e.g., the same size as two SPB33 modules, but with pitched roof). In such a manner, the frame 36 is reconfigurable into different configurations (e.g., depending on a particular application or current need).

Figure 9D:
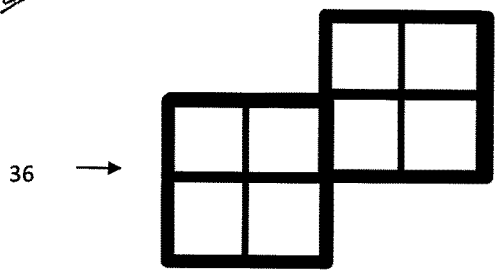
FIG. 9D is a diagram representing two SPB66 modules joined side by side and offset by one half to form an 8-shaped enclosure in accordance with aspects of the disclosure.

On the other hand the units do not have to be attached matching side by side by width. FIG. 9D shows diagram of two SPB66 modules attached to each other in "offset" configuration. For example, FIG. 9D is a diagram representing two SPB66 modules 36 joined side by side and offset by one half to form an 8-shaped enclosure in accordance with aspects of the disclosure. SPB66 may be also extended side-by-side for as long as needed similar to the SPB33 module, forming 6×9, 6×12 etc., —long units or odd shaped units. In accordance with aspects of the disclosure, combining the SPB66 modules 36 along the pitched roof line allows for elimination of the middle support poles inside. Yet other shapes are also possible making 12×12 units and so on, for example, if the internal support poles that may be necessary can be tolerated. In such a manner, in accordance with aspects of the disclosure, a plurality of frames 36 is combinable into different configurations (e.g., depending on a particular application or current need).

Figure 10A:
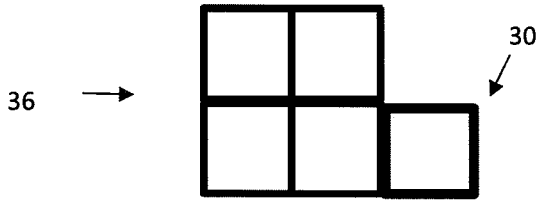
FIG. 10A is a diagram representing one SPB33 module and one SPB66 module joined side by side to form a 6-shaped enclosure in accordance with aspects of the disclosure.
Figure 10B:
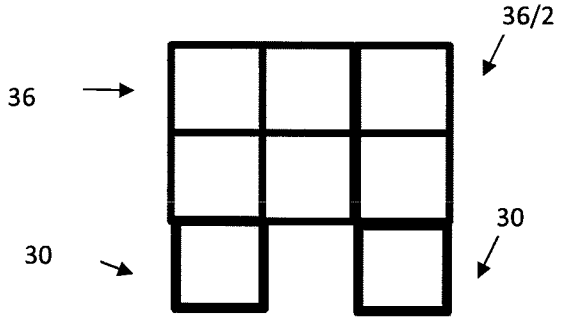
FIG. 10B is a diagram representing two SPB33 modules, one SPB66 module and one half of an SPB66 module joined side by side to form a C-shaped enclosure in accordance with aspects of the disclosure.

Modules SPB66 and SPB33 (and/or portions thereof) may also be combined together if so desired. This option allows for formation of even more shapes. Diagram on FIG. 10A shows one SPB66 module and one SPB33 module combined. FIG. 10A is a diagram representing one SPB33 module 30 and one SPB66 module 36 joined side by side to form a 6-shaped enclosure in accordance with aspects of the disclosure. Referring now to FIG. 10B there is shown one SPB66 module, one half of SPB66 module (36/2), and two SPB33 modules combined. For example, FIG. 10B is a diagram representing two SPB33 modules 30, one half of SPB66 module (36/2) and one SPB66 module 36 joined at sides to form a C-shaped enclosure in accordance with aspects of the disclosure. In accordance with aspects of the disclosure, such a C-shape (or an E-shape using, e.g., three SPB33 modules are attached to one and one half SPB66 modules) may be utilized, for example, in multi-track recording, in which some instruments are separated from each other (e.g., in different ends of the "C-shape) to prevent (or reduce) "bleeding" of sound. Some embodiments may also utilize internal partitions (e.g., with windows) within a structure. Such an arrangement may be achieved, for example, using a plurality of SPB33 modules 30 within a larger (e.g., SPB66) module. For example, when recording, some musicians, while being sonically isolated, may want to be in the same "room" as the other players, so as to have visual contact.

Diagram on FIGS. 11 A to 11 C represent a schematic cross-section of an exemplary hinged connection in accordance with aspects of the disclosure. The hinge is structured and arranged to have the pivoting axle protruding away from the frame itself. In accordance with aspects of the disclosure, the hinge arranged to accommodate for the thickness of the soundproofing wall materials that hang from the door frame and wall frames. FIG. 11A is a diagram representing the door hinge design, attached to the door frame, with the door closed. Cross sectional view from the top in accordance with aspects of the disclosure. As shown in FIG. 11A, a hinge 50 is attached to the immobile portion of the door frame 51 and to the movable portion of the door 52. Once the whole booth is assembled (e.g., frame, walls and all), the extended hinge axle will line up with the outer side of the composite wall and provides for the smooth opening and closing of the door.

FIG. 11B is a cross-sectional top schematic view of an exemplary and non-limiting embodiment of a door hinge, with soundproof panels attached, (Door Closed) in accordance with aspects of the disclosure. FIG. 11B depicts the same hinged connection with soundproof panels 53 and 54 applied (or arranged). As shown in FIG. 11B, hinge cover 13 has one side attached (e.g., permanently attached) to immobile part 53 and mobile part 54 provides reliable connection when the door is closed. In embodiments, the hinge cover 13 may also include a limp pass barrier liner to prevent the sound from leaking through the crack, e.g., when the door is closed. In exemplary embodiment, the axle of the hinge extends from the frame itself by approximately 3 cm. In accordance with aspects of the disclosure, this spacing is provided to accommodate the thickness of the panels that will be attached to the door frame. In embodiments, the hinges are designed to support the weight of heavy soundproof panels.

FIG. 11C is a schematic cross-sectional top view of the door hinge, with soundproof panels attached in a door-open position in accordance with aspects of the disclosure. That is, shown in FIG. 11C is the hinged connector as in the FIG. 11B, but now the door is open. In accordance with aspects of the disclosure, the hinge cover 13 is flexible and allows for free opening of the door.

FIG. 12 depicts a wheel caster attached to the door frame in accordance with aspects of the disclosure. For example, as shown in FIG. 12, a wheel caster 49 may be attached to the bottom corner connector 59 of the door 42. In an exemplary embodiment the weight of the door with the panel on it is approximately 60 lbs. Without a support (e.g., a wheel caster), opening and closing the door may be challenging in terms of weight alone. Additionally, opening and closing the door would shake (or vibrate) the whole structure, possibly causing the structure to feel unstable. Thus, in accordance with aspects of the disclosure, the wheel caster 49 may be attached to bottom of the door 42 to allow for an easier and smoother opening and closing. As shown in FIG. 12, in embodiments, the wheel caster 49 includes a guard 55. Since the outer wall may comprise a soft material, the wheel without a guard potentially can roll onto the door panel and cause damage (or may simply fail to open smoothly or at all). In accordance with aspects of the disclosure, the door guard 55 prevents the fabric of the door from being caught into the rolling part of the wheel caster 49. In accordance with additional aspects of the disclosure, the wheel caster 49 is structured and arranged to have an adjustable height. By implementing this aspect of the disclosure, the height of the wheel may be adjusted to accommodate an anti-vibration mat that may optionally be used as a floor with the booth. For example, in embodiments, the wheel caster 49 may be arrangable in one of two discrete positons (e.g., using bolts). For example, in a "normal" configuration the wheel of the wheel caster 49 is level with the bottom surface of the frame. In an "adjusted" position, the wheel may be arranged to be, for example, one inch below the frame (e.g., to accommodate the mat having a one inch thickness). In other contemplated embodiments, the wheel caster 49 may be attached for incremental height adjustment, via. e.g., a slider instead of the bolts, to provide for an incremental (i.e., not discrete) changeability in the height of the caster wheel 49. Such an arrangement may be used, for example, to adjust for the thickness of a particular carpet on which the booth is currently arranged. In embodiments, the wheel caster 49 may be a non-swivel caster. In embodiments, the wheel caster 49 may comprise a rubber wheel. In further embodiments, the wheel caster 49 may comprise a plastic or polymer wheel.

Additional aspects of the disclosure are directed to a composite vibration cancelling floor mat usable in combination with the sound booth assembly. In an exemplary embodiment, the mat comprises a top liner of reinforced mass loaded vinyl (e.g., a limp mass barrier reinforced with ballistic nylon) attached to a thick resilient rubber padding. In accordance with aspects of the disclosure, the rubber padding serves to cancel structural vibrations and to decouple the booth and the instruments/user in the booth, and the mass loaded vinyl acts as a sound barrier.

Figure 13A:
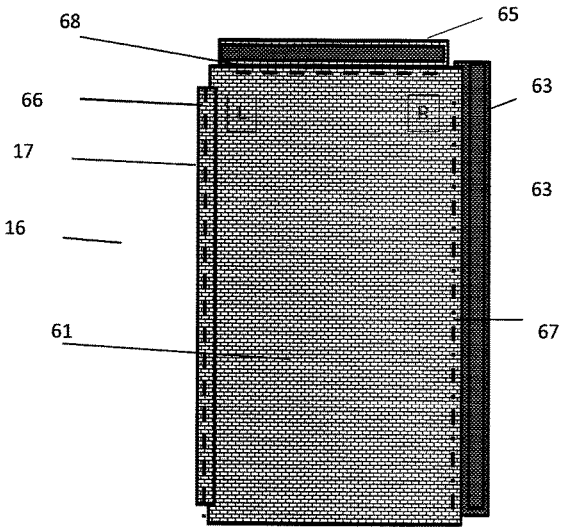
FIG. 13A is a diagram of an exemplary and non-limiting soundproofing panel (as viewed from the inside the booth) in accordance with aspects of the disclosure.

Referring now to FIGS. 13A to 15B there are shown soundproofing (or sound isolation) panels in various configurations, with fasteners and flaps. In accordance with aspects of the disclosure, the soundproofing (or sound isolation) panels are structured and arranged to provide sound proofing (or sound isolation) qualities to the booth. In embodiments of the disclosure, the panels comprise two elements, i.e., the outer casing, and the soundproof layers. In accordance with aspects of the disclosure, the casing includes attachments, such as, for example, flaps, Velcro tie ups, and zippers, and may include windows. In embodiments, the casing it is a "bag" or container structured and arranged to accommodate the soundproofing material therein. In accordance with aspects of the disclosure, soundproof (or sound isolation) panels are enclosed in the casing. The casing may include a zipper closure, so that once a panel is arranged therein, the casing may be zipped closed. In embodiments, soundproof panels comprise limp mass sound barrier material. In embodiments, the connection flaps themselves may contain only reinforced limp mass barrier (e.g., mass loaded vinyl (or "MLV") as a sound proof panel. In contrast, the wall panels may include several layers, e.g., sound-blocking layer of MLV and sound absorption layer of Acoustic Felt (or "AFelt"). Layers of MLV/AFelt, or MLV/AFelt/MLV/AFelt May come in different thickness. In embodiments, the MLV may be reinforced by nylon. FIG. 13A is a diagram of an exemplary and non-limiting soundproofing panel (as viewed from the inside the booth) in accordance with aspects of the disclosure. Referring now to FIG. 13A there is shown a diagram of soundproof wall panel 16, viewed from the outside. When the module is fully assembled with the case and frame, what is actually visible from the outside is the outer case to which the fasteners and the flaps are attached. (The soundproof panels are enclosed inside the outer case.).

As shown in FIG. 13A, the outside fabric 61 of the wall panel 16 includes attached fasteners 66 to one of vertical side to match fastener 67 on the opposite side of the wall panel 16. Fastener 68 is structured and arranged to connect to the corresponding fastener on the roof panel (not shown). Outer flap 17 is structured and arranged to cover the seam when two panels are joined together. Internal vertical flap 63 comprised of a sound barrier, is structured and arranged to seal the crack between the adjacent panels from the inside to block the sound from leaking in or out. Flap 65 at the top of the panel is structured and arranged to serve the same purpose (e.g., seal the crack between the adjacent panels from the inside to block the sound from leaking in or out) at the connection between the roof and the wall panels.

Figure 13B:
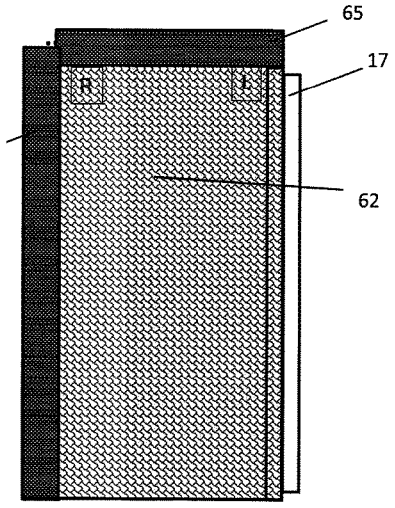
FIG. 13B is a diagram of the same exemplary soundproofing panel (as viewed from the outside the booth) in accordance with aspects of the disclosure.

FIG. 13B is a diagram of the same exemplary soundproofing panel (as viewed from the outside the booth) in accordance with aspects of the disclosure. FIG. 13B shows the inner side 62 of the wall panel 16 with inner flaps 63 and 65 and outer flap 17.

Figure 14:
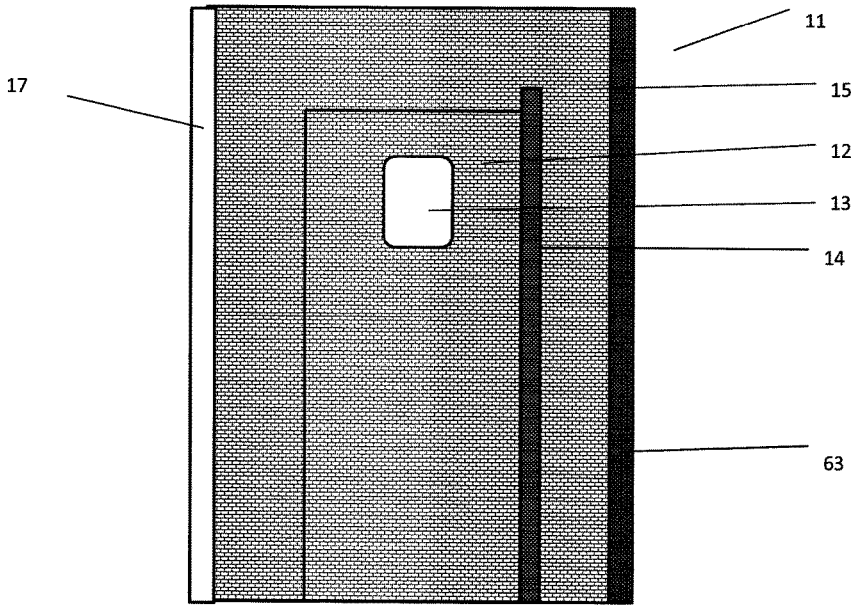
FIG. 14 is a diagram of the soundproofing panel with the door in accordance with aspects of the disclosure.

FIG. 14 is a diagram of the soundproofing panel with the door in accordance with aspects of the disclosure. FIG. 14, shows the panel 11 with the door 12 having on it window 13. The door 12 is attached by a hinge cover 14 to the stationary portion 15 of the panel.

Figure 15A:
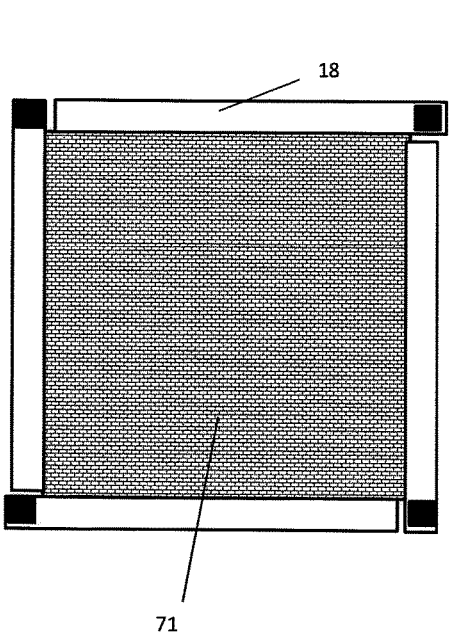
FIG. 15A is a diagram of a roof panel for the exemplary first configuration (e.g., SPB33 module) (as viewed from outside the booth, e.g., Roof top view) in accordance with aspects of the disclosure.

FIG. 15A is a diagram of a roof panel 70 for the exemplary first configuration (e.g., SPB33 module) (as viewed from outside the booth, e.g., Roof top view) in accordance with aspects of the disclosure. As shown in FIG. 15A, a roof panel 70 for module SPB33 with outer side 71 facing upwardly and outer flaps 18 on each side of the panel 70.

Figure 15B:
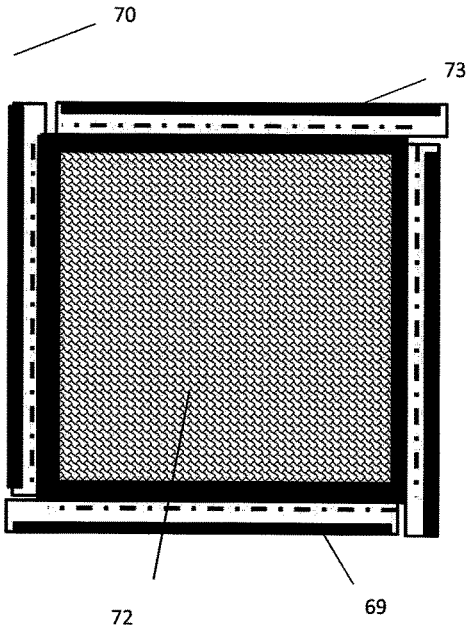
FIG. 15B is a diagram of a roof panel for the exemplary first configuration (as viewed from the inside the booth, e.g., Ceiling view) in accordance with aspects of the disclosure.

FIG. 15B is a diagram of a roof panel 70 for the exemplary first configuration (as viewed from the inside the booth, e.g., ceiling view) in accordance with aspects of the disclosure; As shown in FIG. 15B, the roof panel 70 for module SPB33 with the inner side 72 facing upwardly. The fastener 69 is structured and arranged to connect to (and fasten to) the corresponding fastener 68 of the wall so as to join the wall and the roof together.

Figure 16:
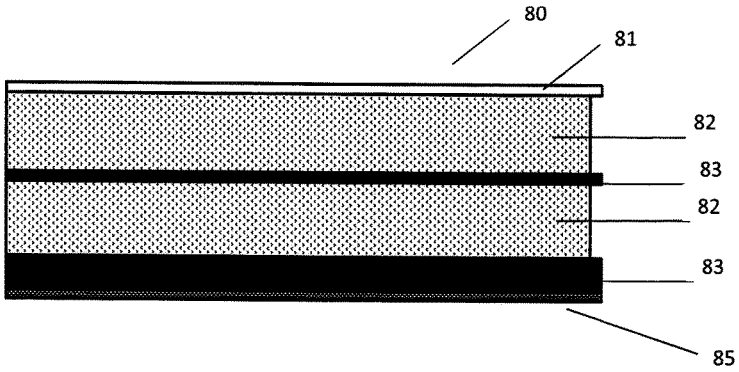
FIG. 16 is a diagram showing an exemplary and non-limiting embodiment of the layered structure of the soundproof panels (inserts in wall, roof and door casings) in accordance with aspects of the disclosure.

FIG. 16 is a diagram showing an exemplary and non-limiting embodiment of the layered structure of the soundproof panels in accordance with aspects of the disclosure. As shown in FIG. 16, the multilayered construction of soundproof panels 80 (e.g., roof or wall panels, which may be structured in a similar manner) may be comprised of a plurality of layers. In embodiments, the panel 80 includes at least one layer of sound blocking material 83, e.g., a limp mass sound barrier (e.g., layer of mass loaded vinyl). Additional layers (e.g., sound blocking materials and or sound absorption layers) may be added as desired. In accordance with aspects of the disclosure, in embodiments the sound-blocking layers 83 (e.g., layer of mass loaded vinyl having 3 kg/m$^3$ or 7 kg/m$^3$) may be interlaced with sound absorption layers 82 (e.g., sound absorption fiber material) to achieve maximum sound-proofing effect (and to render fire retardant). In an exemplary embodiment the outer layer of limp mass barrier 83 is reinforced with a strong, tear resistant fiber 85 (e.g., a nylon fabric), and the inner side of the sound absorption layer 82 may also be covered with layer of protective fabric 81 (e.g., a nonwoven fabric). In embodiments, the strong, tear resistant fiber 85 may also be used to form the casing. In accordance with aspects of the disclosure, the soundproof panel 80 is inserted in a casing (e.g., formed of a strong, tear resistant fiber) with the reinforced limp mass barrier side preferably facing outwardly and the sound absorption side facing inwardly for better acoustics within the enclosure.

Figure 17:
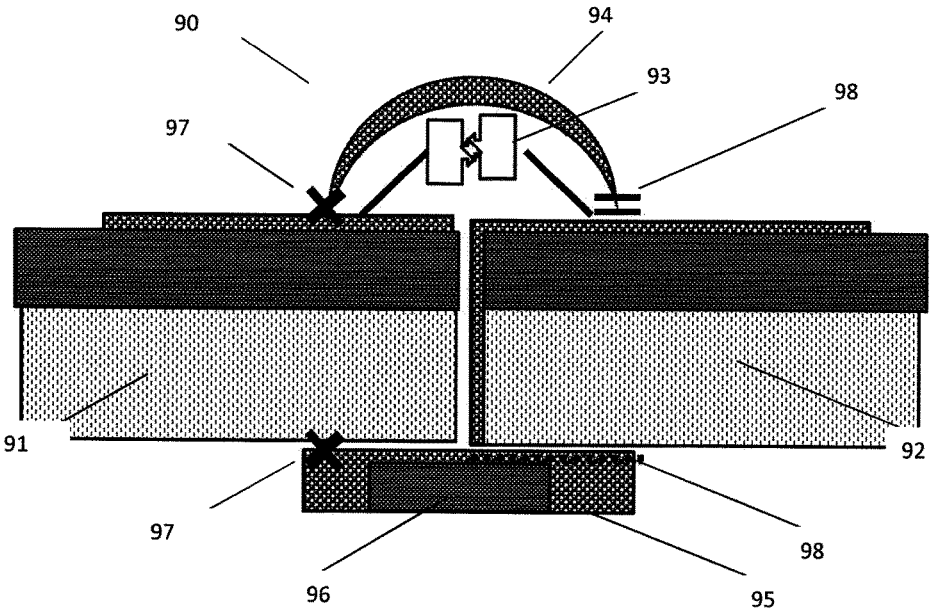
FIG. 17 is a diagram showing an exemplary and non-limiting embodiment of how two adjacent walls are connected together. Cross sectional view from top in accordance with aspects of the disclosure.
Figure 18A:
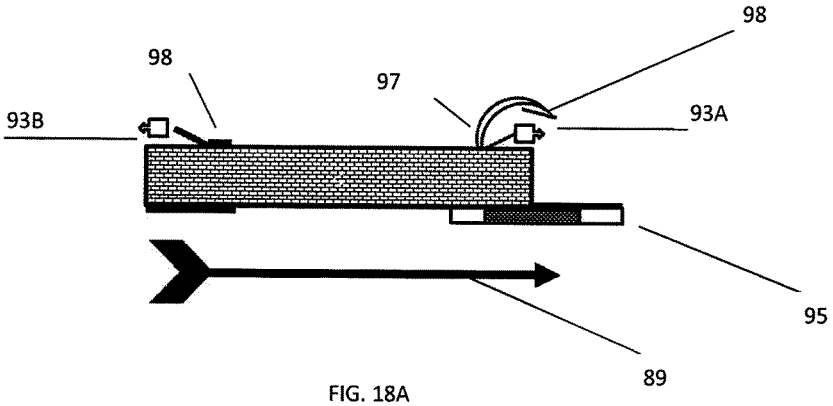
FIG. 18A is a diagram showing an exemplary and non-limiting embodiment in which all wall panels are uniformly designed to fit each other similar to tongue/groove connection (like an arrow with a head and a tail) in accordance with aspects of the disclosure.
Figure 18B:
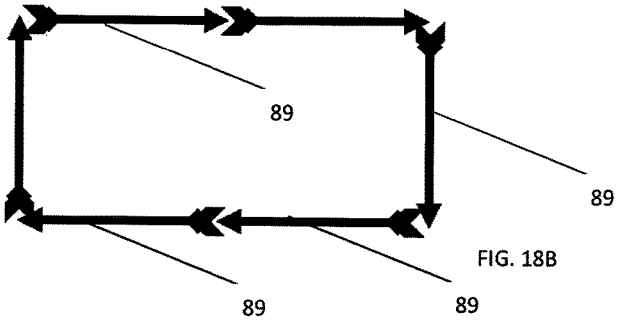
FIG. 18B is a diagram of an exemplary configuration (e.g., double SPB 33 unit (or SPB63)) showing how these panels connect to each other in an assembly in accordance with aspects of the disclosure.
Figure 19:
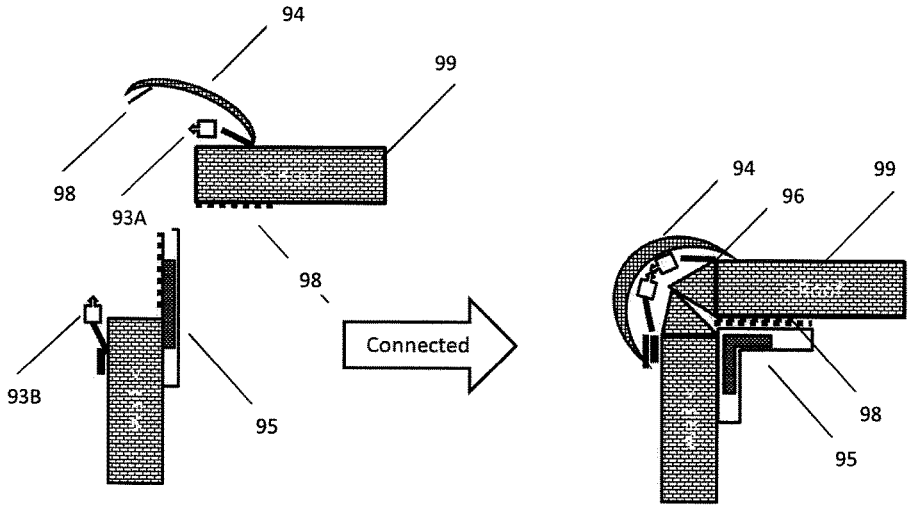
FIG. 19 is a diagram showing an exemplary and non-limiting embodiment of how the wall panel connects to the roof panel via similar uniform connection method in accordance with aspects of the disclosure.

Referring now to FIGS. 17 to 19 there is shown a diagram explaining an exemplary way the panels are connected to each other. FIG. 17 is a schematic cross-sectional view (from above) showing an exemplary and non-limiting embodiment of how two adjacent walls may be connected together in accordance with aspects of the disclosure. As shown in FIG. 17, two adjacent wall panels, first panel 91 and second panel 92 are connected to each other. In principal, only one fastener 93 that would reliably keep the two panels as close to each other as possible is sufficient. In exemplary embodiments, however, a plurality of fasteners and flaps are utilized to provide even better soundproofing and a more aesthetic appearance of the whole assembly. The first panel 91 and the second panel 92 kept together by fastener 93, (e.g., a zipper). Outer flap 94 is attached to the first panel 91 with stitching 97. The flap 94 is structured and arranged to cover over the fastener 93 and releasably attaches to the fastener 98 on the second panel. The purpose of this flap 94 is both decorative and also to protect the fastener 93 (e.g., zipper).

Inner flap 95 comprises limp mass barrier liner 96. The inner flap 95 is also fixedly attached to panel A (e.g., with stitching) and releasably attached to Panel B (via hook-and-loop fastener, for example). While the exemplary embodiment, has both the outer flap 94 and inner flap 95 fixedly attached to the first panel 91, it should be understood that both flaps need not be attached to the first panel 91. For example, one flap (e.g., outer flap) may be attached to the first panel and one flap (e.g., the inner flap) may be attached to the second panel 92, as long as all wall panels are consistently configured (with regard to the flap arrangements) and can be joined consecutively.

FIG. 18A is a diagram showing an exemplary and non-limiting embodiment in which all wall panels are uniformly designed to fit each other similar to tongue/groove connection (like an arrow with a head and a tail) in accordance with aspects of the disclosure. Referring now to FIG. 18A there is shown a diagram where the wall panels represented by an arrow 99. The two matching (or corresponding) parts of the fastener 98 (e.g., hook-and-loop fastener) are located on the opposite sides of a panel, such as 93B on one side and 93A on the opposite side. With an exemplary assembly, a right edge of a first panel (Panel A) connects to the left edge of a second panel (Panel B) by arranging the two panels adjacent one another (e.g., in contact). From the outside a first zipper element of the zipper 93 is connected with second zipper element of the zipper 93. The zipper 93 is then covered with the outer flap 94, which is arranged so that a fastener element 98 is in engaging contact with a corresponding fastener element on the second panel. From the inside, the panels are pulled together as close as possible and the inner flap 95 is arranged so that a fastener element thereon is in engaging contact with a corresponding fastener element on an interior surface the second panel. In accordance with aspects of the disclosure, the fasteners and flaps, are structured and arranged in a manner that the panel can actually connect to itself (e.g., using the parts of the fastener 93) if rolled into a cylinder.

FIG. 18B is a diagram of an exemplary configuration (e.g., double SPB 33 unit (or SPB63)) showing how these panels connect to each other in an assembly in accordance with aspects of the disclosure. FIG. 18B shows how consecutive walls (represented by arrows 99) may be attached to each other. In accordance with aspects of the disclosure, this method allows for any wall to be adjoined to any other wall in a chain (e.g., "circular" chain, in which one end vii the chain connects to another end of the chain) as long as needed (e.g., for a particular sound booth application). The stationary portion of a panel with the door is designed in the same fashion, so it can be connected anywhere in the chain of panels. In such a manner, in accordance with aspect of the disclosure, this allows for adding several door modules to a sound booth structure, if necessary or desired.

FIG. 19 is a diagram showing an exemplary and non-limiting embodiment of how the wall panel connects to the roof panel via similar connection method in accordance with aspects of the disclosure. As shown in FIG. 19, a wall panel connects to the roof panel. In accordance with aspects of the disclosure, the connection uses the same design elements and the same fasteners as the wall-to-wall connections (with the difference that instead of bending over the vertical corner it bends over horizontal corner). As shown in FIG. 19, in some embodiments, corner elements 96 may be arranged adjacent the joining region of the wall panels and the roof panel to provide additional structural stability and/or additional sound absorption.

Figure 20A:
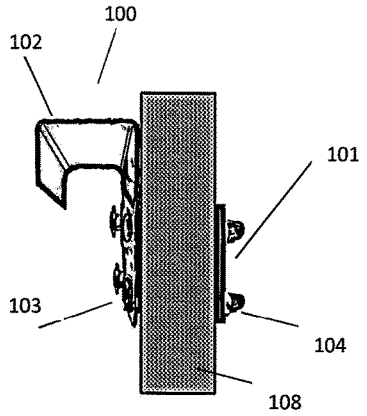
FIG. 20A is a diagram showing an exemplary and non-limiting embodiment of a hook bracket attached to the wall soundproofing panel in accordance with aspects of the disclosure.
Figure 20B:
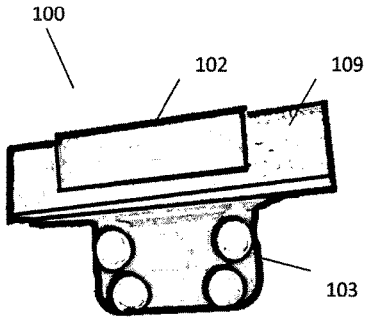
FIG. 20B depicts a view of the hook bracket hooked onto a frame in accordance with aspects of the disclosure.

Referring now to FIGS. 20A and 20B there is show a hook bracket and method of using the same in accordance with aspects of the present disclosure. FIG. 20A is a diagram showing an exemplary and non-limiting embodiment of a hook bracket 100 attached to the wall soundproofing panel 108. In accordance with aspects of the disclosure, mounting hooks of the hook bracket 100 are structured and arranged to allow for quickly hanging the panels on the booth frame. Referring now to FIG. 20A there is shown a hook bracket 100 with the hook plate 102 attached to the wall panel 108. Bolts 103 pass through holes in the hook plate 102, the wall panel 108 and the flat panel 101 and secured with nuts 104.

FIG. 20B depicts a view of the hook bracket hooked onto a frame in accordance with aspects of the disclosure. Referring now to FIG. 20B shows an exemplary overview of the hook bracket 100 hooked on a horizontal support member 109 of the frame of the soundproof booth. In such a manner, the walls of the soundproof booth may be "hung" from the frame, and secured to one another to form the soundproof booth.

Figure 21:
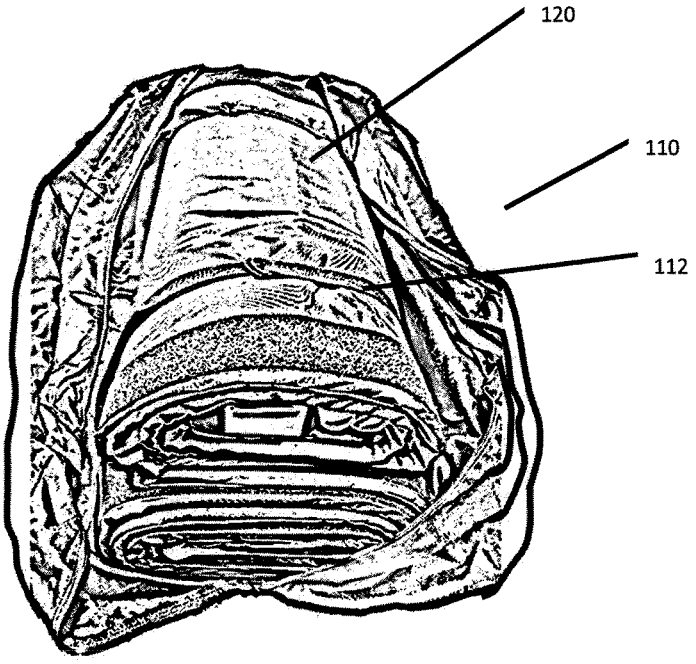
FIG. 21 is a view of an enclosure rolled-up for transportation and/or storage and placed in a bag (bag is open) in accordance with aspects of the disclosure.

FIG. 21 is a view of an enclosure rolled-up for transportation and/or storage and placed in a bag in accordance with aspects of the disclosure.

As shown in FIG. 21, the SPB module parts 120 can be rolled up and enclosed into the transport bag 110. Bag 110 is open (e.g., unzipped). In embodiments, retaining straps 112 attached to an interior of the bag 110 are structured and arranged to hold the panels wrapped tight to the bag 110 itself.

Figure 22:
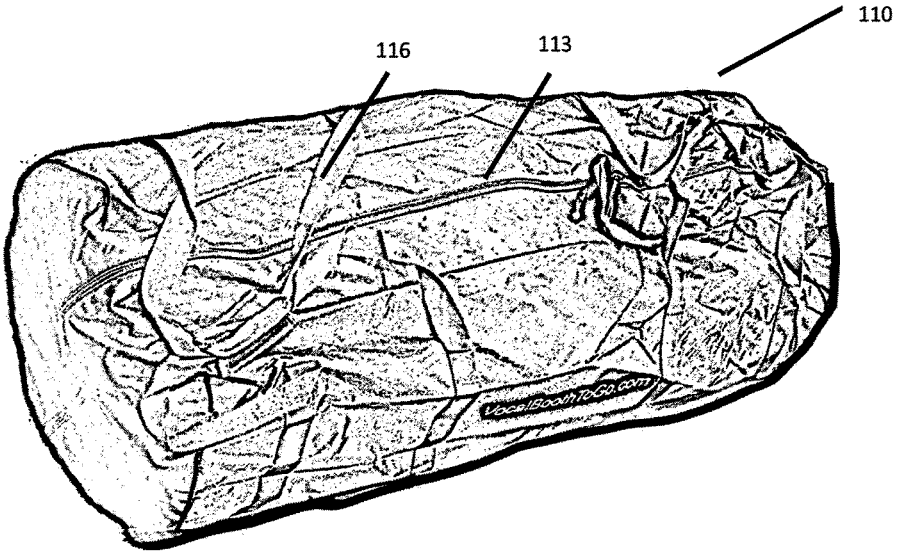
FIG. 22 is a view of a closed bag with the sound booth enclosure in it ready for transportation and/or storage in accordance with aspects of the disclosure.

FIG. 22 is a view of a bag with the sound booth enclosure in it ready for transportation in accordance with aspects of the disclosure. That is FIG. 22 depicts the bag 110 (with transportation handles 116) that is closed (e.g., with a zipper 113).

The above description makes the structure and the potential use of the device clear. But for practical reasons additional elements may be employed to improve the structural soundness of the assembly, improve the appearance of the device, make it more practical and easy to use, and reduce wear and tear.

While the disclosure has been described in connection with a preferred embodiment, it is not intended to limit the scope of the disclosure to the particular form set forth, but on the contrary, it is intended to cover such alternatives, modifications, and equivalents as may be included within the spirit and scope of the disclosure as defined by the appended claims.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel configuration is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure refers to specific embodiments, those skilled in the art will understand that various changes may be made and equivalents may be substituted for elements thereof without departing from the true spirit and scope of the embodiments of the disclosure. For example, while the exemplary embodiments are directed to sound isolation booths having frame with a rectangular footprint, the disclosure contemplates that sound isolation booths having frames of differently-shaped footprints, e.g., circular footprints. With such embodiments, the structural poles may be curved instead of straight, and the connectors are structured (e.g., curved or rounded) to connect the curved structural poles. While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

| | |
|---|---|
| 10 | module SPB33 Overview |
| 11 | Soundproof (or sound isolation) panel with the door |
| 12 | Swing Door panel. Mobile part |
| 13 | Window |
| 14 | Hinge cover flap |
| 15 | stationary part of the Soundproof panel with the door |
| 16 | Soundproof (or sound isolation) wall panel |
| 17 | Flap to cover the wall to wall fastener on the outside |
| 18 | Flap to cover the Roof to wall fastener on the outside |
| 19 | |
| 20 | module SPB66 Overview |
| 21 | structural Pole |
| 22 | Pitched wall panels |
| 23 | |
| 24 | |
| 25 | |
| 26 | |
| 27 | |
| 28 | |
| 29 | |
| 30 | Module SPB 33 Frame |
| 31 | structural pole |
| 32 | 2-way straight connector |
| 33 | 3-way corner connector |
| 34 | 4-way wide angle roof connector |
| 35 | 4-way middle angular connector 35 |
| 36 | Module SPB 66 Frame |
| 36/2 | Half of Module SPB 66 Frame |
| 37 | SPB66 angular roof connector |
| 38 | T-connector |

-continued

| | |
|---|---|
| 39 | 3-way wide angle roof connector |
| 40 | Swing Door frame Module |
| 41 | Door frame |
| 42 | Swing door |
| 43 | Top door frame connector |
| 44 | Hinged Top Door frame connector |
| 45 | Middle door frame H-connector |
| 46 | Hinged Middle door frame H-connector |
| 47 | Bottom door frame T connector |
| 48 | Hinged Bottom door frame T-connector |
| 49 | Wheel caster |
| 50 | Door Hinge |
| 51 | stationary part of a hinged connector (attached to frame) |
| 52 | Mobile part of the hinged connector (attached to swing door) |
| 53 | Immobile part of the panel with Door |
| 54 | Mobile part of the panel with swing door; |
| 55 | guard |
| 56 | |
| 57 | |
| 58 | |
| 59 | L-shaped bottom door connector opposite to Hinged connector |
| 60 | |
| 61 | Outer sound blocking layer |
| 62 | Inner sound absorption layer |
| 63 | Wall-to-wall connection Flap on the inside with sound blocking liner |
| 64 | |
| 65 | Roof to wall Top flap on the inside with sound blocking liner |
| 66 | Fastener - zippered half A |
| 67 | Fastener - zippered half B |
| 68 | Fastener for roof to wall panel connection - half A |
| 69 | Fastener for roof to wall panel connection half B |
| 70 | SPB33 Soundproof (or sound isolation) Roof panel |
| 71 | Roof panel outer sound blocking side |
| 72 | Roof panel inner sound absorption side |
| 73 | Flap to cover the Roof to wall fastener on the outside view from the inside |
| 74 | |
| 75 | |
| 76 | |
| 77 | |
| 78 | |
| 79 | |
| 80 | Composite sound blocking panel cross section |
| 81 | Inner fabric liner |
| 82 | Sound absorption fibrous material |
| 83 | Sound blocking limp mass barrier |
| 84 | |
| 85 | Reinforcing fabric liner |
| 86 | |
| 87 | |
| 88 | |
| 89 | |
| 90 | Inter-panel connection diagram |
| 91 | Panel A |
| 92 | Panel B |
| 93 | Panel-to-panel fastener |
| 93A | Panel to Panel fastener half A |
| 93B | Panel to Panel fastener half B |
| 94 | Outside flap |
| 95 | Internal flap |
| 96 | Sound blocking liner in the internal flap |
| 97 | Permanent connection (e.g., stitched) |
| 98 | Detachable connection |
| 99 | Panel R - roof panel |
| 100 | SPB mounting hook Bracket |
| 101 | Flat bracket panel |
| 102 | Hook bracket |
| 103 | Fastener - Bolts |
| 104 | Fastener - Nuts |
| 105 | |
| 106 | |
| 107 | |
| 108 | Sound blocking wall panel |
| 109 | Portion of the frame |
| 110 | SPB bag |
| 111 | |
| 112 | Retaining Straps |
| 113 | Zipper |

-continued

| | |
|---|---|
| 114 | |
| 115 | |
| 116 | Carry Handles |
| 117 | |
| 118 | |
| 119 | |
| 120 | Booth components. Wall. door or roof panels. Frame parts etc. |

What is claimed is:

1. A mobile modular sound isolation enclosure having a swing opening door, wherein the sound isolation enclosure is collapsible into a carry bag and shippable by a regular postal carrier, the sound isolation enclosure comprising:

a modular frame structure comprising structural members that are assemblable in different configurations so as to form frames of different shapes and/or sizes;

a door frame module, including a swing opening door frame;

a plurality of modular soundproofing panels comprising flexible composite layered sound blocking material and sound absorbent sheet material, wherein at least one of the plurality of modular soundproofing panels includes the swing opening door, wherein each of the plurality of modular sound proofing panels comprise attachers operable to connect adjacent sound proofing panels consecutively to one another to form a continuous wall of the sound isolation enclosure, and wherein at least some of the plurality of modular soundproofing panels comprise hook brackets attached thereto, which are structured and arranged to engage with the modular frame structure so that the modular soundproofing panels hang from the modular frame structure.

2. The modular sound isolation enclosure of claim 1, wherein the frame structure is assemblable into different configurations of different sizes and/or shapes by adding on or subtracting components.

3. The modular sound isolation enclosure of claim 1, wherein when the plurality soundproofing panels are arranged on the frame to form a soundproofing enclosure, the sound isolation enclosure is formed.

4. The modular sound isolation enclosure of claim 1, further comprising a plurality of light-weight frame components and a plurality of connectors that are assemblable to form the modular frame structure (and disassemblable) by a single person without need for tools.

5. The modular sound isolation enclosure of claim 1, wherein the frame is structured to be repeatedly disassembled and reassembled multiple times as needed.

6. The modular sound isolation enclosure of claim 1, wherein the frame is sized such that in a disassembled state, the frame is able to fit in a trunk of a car.

7. The mobile modular sound isolation enclosure of claim 1, wherein the soundproofing panels comprise intermittent sound blocking and sound absorbing layers structured and arranged to remain flexible, such that the soundproofing panels can be folded and/or rolled up.

8. The mobile modular sound isolation enclosure of claim 1, wherein the soundproofing panels further comprise a limp mass barrier reinforced with fabric.

9. The mobile modular sound isolation enclosure of claim 1, wherein the soundproofing panels are structured and arranged to hang on the fame without permanent attachment thereto.

10. The mobile modular sound isolation enclosure of claim 1, wherein the swing opening door is structured and arranged to be disassembled and rolled up.

11. The modular sound isolation enclosure of claim 1, wherein the attachers comprise a first zipper element attached to one panel with a corresponding second zipper element on an adjacent panel.

12. The modular sound isolation enclosure of claim 11, wherein the attachers additionally comprise a flap attached to one panel with a connecting surface that is engageable with a corresponding connecting surface of an adjacent panel.

13. The modular sound isolation enclosure of claim 12, wherein the flap, when the connecting surface is engaged with the corresponding connecting surface is operable to cover the first and second zipper elements.

14. The modular sound isolation enclosure of claim 1, wherein the structural members comprise a plurality of structural poles and a plurality of connectors that are assemblable in different configurations.

15. The modular sound isolation enclosure of claim 14, wherein the plurality of connectors comprise two-way connectors and corner 3-way connectors.

16. The modular sound isolation enclosure of claim 15, wherein the plurality of connectors additionally comprise T-connectors, 3-way wide angle roof connectors, 4-way wide angle roof connectors, and 4-way middle angular connectors, or curved connectors.

17. The modular sound isolation enclosure of claim 1, wherein the continuous wall of the sound isolation enclosure includes one or more soundproofing panels forming a roof of the sound isolation enclosure.

18. A mobile modular sound isolation enclosure having a swing opening door, wherein the sound isolation enclosure is collapsible into a carry bag and shippable by a regular postal carrier, the sound isolation enclosure comprising:

a modular frame structure comprising structural members that are assemblable in different configurations so as to form frames of different shapes and/or sizes;

a door frame module, including a swing open door frame;

a plurality of modular soundproofing panels comprising flexible composite layered sound blocking material and sound absorbent sheet material, wherein at least one of the plurality of modular soundproofing panels includes the swing opening door, wherein each of the plurality of modular sound proofing panels comprise attachers operable to connect adjacent sound proofing panels consecutively to one another to form a continuous wall of the sound isolation enclosure, wherein the structural members comprise a plurality of structural poles and a plurality of connectors that are assemblable in different configurations, and wherein the plurality of connectors comprise two-way connectors and corner 3-way connectors.

* * * * *